US011435687B2

(12) United States Patent
Kawakita et al.

(10) Patent No.: US 11,435,687 B2
(45) Date of Patent: Sep. 6, 2022

(54) IMAGE FORMING APPARATUS AND IMAGE FORMING SYSTEM

(71) Applicant: CANON KABUSHIKI KAISHA, Tokyo (JP)

(72) Inventors: Akihiro Kawakita, Abiko (JP); Satoru Yamamoto, Noda (JP); Koji Yumoto, Toride (JP); Akinobu Nishikata, Matsudo (JP); Takashi Yokoya, Yoshikawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 452 days.

(21) Appl. No.: 15/985,994

(22) Filed: May 22, 2018

(65) Prior Publication Data

US 2018/0341210 A1 Nov. 29, 2018

(30) Foreign Application Priority Data

May 29, 2017 (JP) ..... JP2017-105271

(51) Int. Cl.
*G03G 15/00* (2006.01)
*B65H 21/00* (2006.01)
(Continued)

(52) U.S. Cl.
CPC ..... *G03G 15/6502* (2013.01); *B65H 7/02* (2013.01); *B65H 7/20* (2013.01); *G03G 15/6511* (2013.01);
(Continued)

(58) Field of Classification Search
None
See application file for complete search history.

(56) References Cited

U.S. PATENT DOCUMENTS 5,126,786 A * 6/1992 Tanaka ..... G03G 15/50 355/46
5,203,552 A * 4/1993 Hoshi ..... B65H 3/44 271/164
(Continued)

FOREIGN PATENT DOCUMENTS

JP 02-120066 A 5/1990
JP 2000-103533 A 4/2000
(Continued)

OTHER PUBLICATIONS

U.S. Appl. No. 15/983,541, Koji Yumoto Satoru Yamamoto Akinobu Nishikata Takashi Yokoya Akihiro Kawakita, filed May 18, 2018.
(Continued)

*Primary Examiner* — Manish S Shah
*Assistant Examiner* — Ruben C Parco, Jr.
(74) *Attorney, Agent, or Firm* — Venable LLP

(57) ABSTRACT

An image forming apparatus is configured to execute a print job for printing on a sheet supplied from a sheet supplying mechanism formed of a first sheet feeding apparatus configured to temporarily stop conveyance of the sheet within a conveyance path thereof or a second sheet feeding apparatus configured not to temporarily stop conveyance of the sheet within a conveyance path thereof. The image forming apparatus includes an image former configured to form an image on the sheet; an obtaining device configured to obtain apparatus information representing a type of an apparatus forming the sheet supplying mechanism; and a controller configured to determine, based on the apparatus information and the sheet supplying mechanism instructed to feed the sheet by the print job, timings to send, to the sheet supplying mechanism, a feed request for starting to feed the sheet and a delivery request for instructing to deliver the sheet.

8 Claims, 9 Drawing Sheets

(51) Int. Cl.
*B65H 7/02* (2006.01)
*B65H 7/20* (2006.01)

(52) U.S. Cl.
CPC ..... *G03G 15/6564* (2013.01); *B65H 2513/10* (2013.01); *B65H 2513/512* (2013.01); *B65H 2513/514* (2013.01); *B65H 2557/35* (2013.01)

(56) References Cited

U.S. PATENT DOCUMENTS

| | | | | |
|---|---|---|---|---|
| 6,266,151 | B1 | 6/2001 | Tachibana et al. | |
| 6,836,640 | B2 * | 12/2004 | Isemura | G03G 15/6561 271/265.01 |
| 8,038,139 | B2 | 10/2011 | Nishimura et al. | |
| 8,413,985 | B2 | 4/2013 | Yamazaki et al. | |
| 2004/0217538 | A1 * | 11/2004 | Kawamura | B65H 5/34 271/9.01 |
| 2007/0120313 | A1 * | 5/2007 | Wada | B65H 19/18 271/9.02 |

FOREIGN PATENT DOCUMENTS

| | | | |
|---|---|---|---|
| JP | 2001-322725 | A | 11/2001 |
| JP | 2004-043057 | A | 2/2004 |
| JP | 2010-072208 | A | 4/2010 |
| JP | 2013-088773 | A | 5/2013 |
| JP | 2014-119679 | A | 6/2014 |
| JP | 2014-168882 | A | 9/2014 |

OTHER PUBLICATIONS

U.S. Appl. No. 15/991,015, Takashi Yokoya Akinobu Nishikata Satoru Yamamoto Koji Yumoto Akihiro Kawakita, filed May 29, 2018.

Office Action dated Apr. 7, 2021, in Japanese Patent Application No. 2017-105271.

* cited by examiner

IMAGE FORMING APPARATUS AND IMAGE FORMING SYSTEM

BACKGROUND OF THE INVENTION

Field of the Invention

The present invention relates to an image forming apparatus and an image forming system for receiving a sheet from a sheet supplying apparatus.

Description of the Related Art

In some cases, an image forming apparatus is supplied with a sheet from an external sheet feeding apparatus. The image forming apparatus forms an image on the sheet fed from the sheet feeding apparatus. The image forming apparatus discharges the sheet subjected to the image formation to deliver the sheet to an apparatus arranged on a subsequent stage. The image forming apparatus adjusts a timing for image formation and a feed timing to feed the sheet from the sheet feeding apparatus (see Japanese Patent Application Laid-Open No. 2001-322725).

There are two kinds of sheet feeding apparatus for supplying a sheet to an image forming apparatus, which include: a sheet feeding apparatus capable of temporarily stopping the conveyance of a sheet on a conveyance path in the sheet feeding apparatus; and a sheet feeding apparatus incapable of temporarily stopping the conveyance of a sheet thereon. In some cases, a sheet conveying apparatus for delivering the sheet from the sheet feeding apparatus to the image forming apparatus is also provided between the image forming apparatus and the sheet feeding apparatus. Irrespective of the configuration of a sheet supplying mechanism employed by the sheet feeding apparatus or the sheet conveying apparatus, the image forming apparatus sends a feed request for instructing to start sheet feeding at a predetermined cycle period, and then sends a delivery request for instructing to deliver the sheet. In order to efficiently perform image forming processing to maintain productivity, the image forming apparatus is desired to feed each sheet at a minimum sheet conveyance time interval (with a minimum sheet-to-sheet interval) between sheets.

The sheet feeding apparatus capable of temporarily stopping the conveyance of a sheet on the conveyance path in the sheet feeding apparatus temporarily stops the conveyance of a sheet on the conveyance path after starting to feed the sheet in response to the feed request, and delivers the sheet to the image forming apparatus in response to the delivery request. The sheet feeding apparatus incapable of temporarily stopping the conveyance of a sheet on the conveyance path in the sheet feeding apparatus starts to feed a sheet in response to the feed request, and without stopping the conveyance of the sheet, delivers the sheet to the image forming apparatus in response to the delivery request. When the sheet conveying apparatus is provided between the image forming apparatus and the sheet feeding apparatus incapable of temporarily stopping the conveyance of a sheet on the conveyance path in the sheet feeding apparatus, the sheet feeding apparatus starts to feed a sheet in response to the feed request. This causes the sheet to be supplied to the sheet conveying apparatus, and then the conveyance of the sheet is temporarily stopped in the sheet conveying apparatus. The sheet conveying apparatus delivers the sheet to the image forming apparatus in response to the delivery request.

The sheet feeding apparatus capable of temporarily stopping the conveyance of a sheet on the conveyance path in the sheet feeding apparatus starts to deliver the next sheet after delivering the sheet to the image forming apparatus so as to prevent a plurality of sheets from colliding with each other within the conveyance path. In the same manner, the sheet conveying apparatus receives the next sheet from the sheet feeding apparatus after delivering the sheet to the image forming apparatus. Depending on the configuration of a sheet supplying mechanism, there is a difference in length of the conveyance path up to a point at which the sheet is supplied to the image forming apparatus. Therefore, the difference in length of the conveyance path leads to a difference in sheet-to-sheet interval due to the configuration of the sheet supplying mechanism. For example, as the conveyance path within the sheet supplying mechanism becomes longer, the sheet-to-sheet interval becomes larger. As the sheet-to-sheet interval becomes larger, the productivity decreases.

SUMMARY OF THE INVENTION

The present invention provides an image forming apparatus configured to determine timings to send a feed request and a delivery request based on apparatus information on an apparatus constructing a sheet supplying mechanism, to thereby supply a sheet while ensuring productivity.

According to one embodiment of the present invention, there is provided an image forming apparatus, which is configured to execute a print job for performing printing on a sheet supplied from one of a first sheet feeding apparatus configured to temporarily stop conveyance of the sheet within a conveyance path thereof and a second sheet feeding apparatus configured not to temporarily stop conveyance of the sheet within a conveyance path thereof, the first sheet feeding apparatus and the second sheet feeding apparatus each serving as a sheet supplying mechanism, the image forming apparatus comprising:

an image former configured to form an image on the sheet based on the print job;

an obtaining device configured to obtain apparatus information representing a type of an apparatus constructing the sheet supplying mechanism; and a controller configured to determine, based on the apparatus information obtained by the obtaining device and the sheet supplying mechanism instructed to feed the sheet by the print job, timings to send, to the sheet supplying mechanism, a feed request for starting to feed the sheet and a delivery request for instructing to deliver the sheet.

Further features of the present invention will become apparent from the following description of exemplary embodiments with reference to the attached drawings.

DESCRIPTION OF THE EMBODIMENTS

The embodiments will be described with reference to the accompanying drawings.

(System Configuration)

Figure 1A:
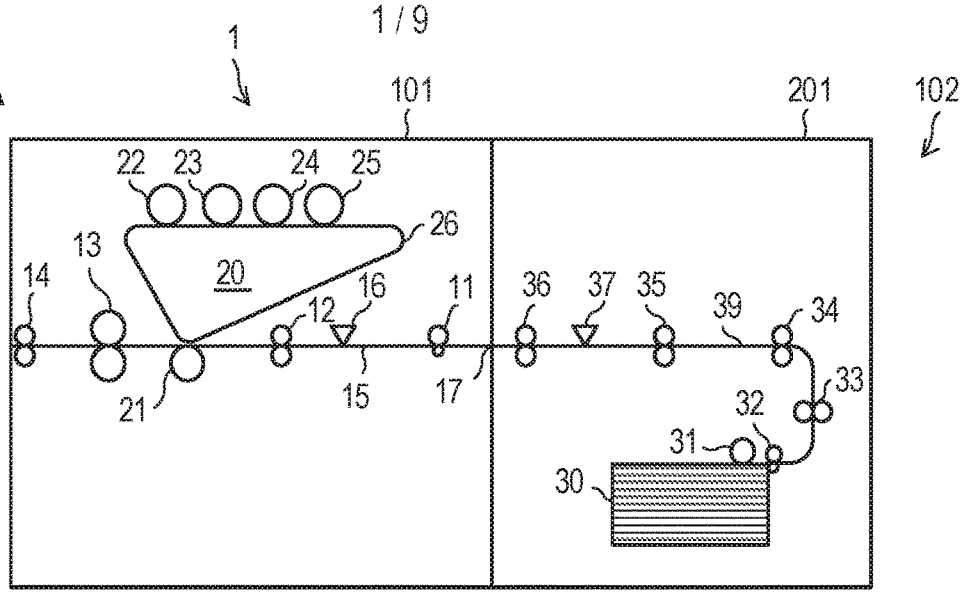
FIG. 1A, FIG. 1B, and FIG. 1C are diagrams for illustrating examples of configurations of an image forming system.
Figure 1B:
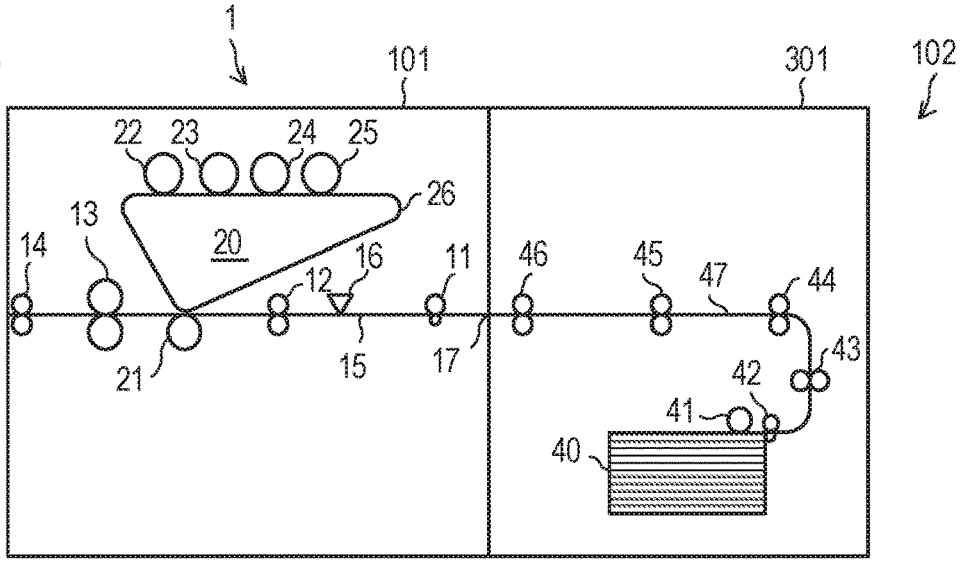
Figure 1C:
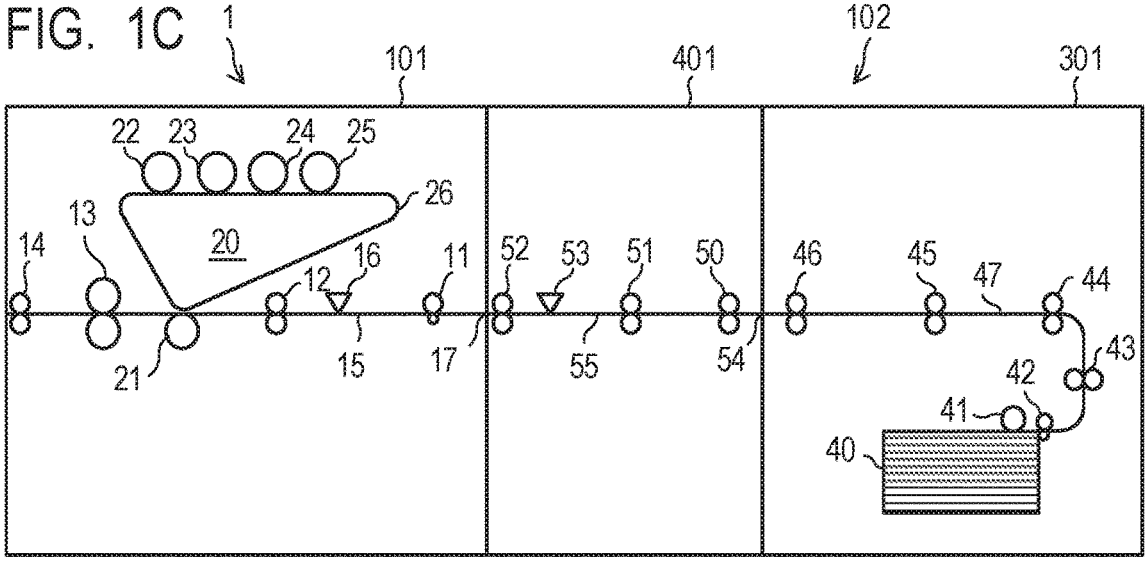

FIG. 1A, FIG. 1B, and FIG. 1C are diagrams for illustrating examples of configurations of an image forming system 1 according to this embodiment, which includes an image forming apparatus 101 and a sheet supplying mechanism 102. In the image forming system 1, the image forming apparatus 101 is provided on a downstream side in the conveyance direction of a sheet. The sheet supplying mechanism 102 configured to supply a sheet to the image forming apparatus 101 is provided on an upstream side of the image forming apparatus 101. The sheet supplying mechanism 102 is formed of a combination of various types of apparatus depending on, for example, the length of a conveyance path and whether or not the conveyance of the sheet can be temporarily stopped on the conveyance path. In this embodiment, the sheet supplying mechanism 102 is formed of a first sheet feeding apparatus 201, a second sheet feeding apparatus 301, or a combination of the second sheet feeding apparatus 301 and a sheet conveying apparatus 401. The image forming apparatus 101 manages an apparatus constructing the sheet supplying mechanism 102 based on an apparatus ID being identification information assigned to each apparatus. The image forming apparatus 101 is capable of obtaining the apparatus ID from the apparatus constructing the sheet supplying mechanism 102 at the time of the set-up or power-on of the image forming system 1 to determine the configuration of the sheet supplying mechanism 102.

The image forming system 1 of FIG. 1A is formed of a combination of the image forming apparatus 101 and the first sheet feeding apparatus 201 being the sheet supplying mechanism 102. The first sheet feeding apparatus 201 is capable of temporarily stopping the conveyance of the sheet on an internal conveyance path 39. The image forming system 1 of FIG. 1B is formed of a combination of the image forming apparatus 101 and the second sheet feeding apparatus 301 being the sheet supplying mechanism 102. The second sheet feeding apparatus 301 is not capable of temporarily stopping the conveyance of the sheet on an internal conveyance path 47. The image forming system 1 of FIG. 1C is formed of the image forming apparatus 101 and a combination of the second sheet feeding apparatus 301 and the sheet conveying apparatus 401, the combination being the sheet supplying mechanism 102. The second sheet feeding apparatus 301 is arranged most upstream with respect to the conveyance direction of the sheet. The sheet conveying apparatus 401 is arranged between the second sheet feeding apparatus 301 and the image forming apparatus 101, and delivers the sheet, which has been fed from the second sheet feeding apparatus 301, to the image forming apparatus 101. The sheet conveying apparatus 401 is capable of temporarily stopping the conveyance of the sheet on an internal conveyance path 55.

The image forming apparatus 101 takes in sheets one by one from the sheet supplying mechanism 102 by the taking-in portion 17, and performs image forming processing on each of the taken-in sheets. To that end, the image forming apparatus 101 includes an image forming portion (image former) 20, a sheet conveying portion, and a fixing portion 13.

The sheet conveying portion includes a horizontal path 15 being a conveyance path for conveying the sheet, which has been taken in from the sheet supplying mechanism 102, toward the downstream side. The horizontal path 15 includes the taking-in portion 17, a conveyance roller pair 11, registration rollers 12, and discharge rollers 14 in order from the upstream side in the conveyance direction of the sheet. A secondary transfer portion 21 (described later) and the fixing portion 13 are provided between the registration rollers 12 and the discharge rollers 14 in order from the upstream side. In addition, a conveyance sensor 16 configured to detect a sheet being conveyed along the horizontal path 15 is provided between the conveyance roller pair 11 and the registration rollers 12.

The sheet supplied from the sheet supplying mechanism 102 is taken into the image forming apparatus 101 by the taking-in portion 17, and is conveyed along the horizontal path 15 by the conveyance roller pair 11. The conveyance sensor 16 detects the sheet being conveyed along the horizontal path 15. The registration rollers 12 are in a stopped state while the sheet is being conveyed by the conveyance roller pair 11. Therefore, the leading edge side of the sheet in the conveyance direction is brought into abutment with the registration rollers 12, and the conveyance of the sheet is temporarily stopped.

The image forming portion 20 includes photosensitive drums 22, 23, 24, and 25, which are photosensitive members, an intermediate transfer member 26, and the secondary transfer portion 21. Images in colors different from one another are formed on the photosensitive drums 22 to 25. The images in the respective colors are transferred onto the intermediate transfer member 26 from the photosensitive drums 22 to 25. While being rotated, the intermediate transfer member 26 carries the transferred images to the secondary transfer portion 21, which is a transfer position for transferring the images onto the sheet. The registration rollers 12 restart the conveyance of the sheet in synchronization with a timing at which the images transferred onto the intermediate transfer member 26 reach the secondary transfer portion 21. In this case, the leading edge of the sheet in the conveyance direction and the leading edge of the image are caused to simultaneously reach the secondary transfer portion 21, to thereby be able to cause the position of the head of the sheet to agree with the position of the head of the image. The secondary transfer portion 21 transfers the images on the intermediate transfer member 26 onto the sheet that has been conveyed, to thereby form an image on the sheet. The intermediate transfer member 26 and the secondary transfer portion 21 serve as a transferer configured to transfer images formed on the photosensitive drums 22 to 25 onto a sheet.

The sheet onto which the images have been transferred is conveyed to the fixing portion 13. The fixing portion 13 heats and pressurizes the sheet, to thereby fix the images to the sheet. The sheet to which the images have been fixed is conveyed to the discharge rollers 14. The discharge rollers 14 discharge the sheet on which the image has been formed to the outside of the image forming apparatus 101. After the above-mentioned steps, the image forming processing for the sheet is brought to an end.

The first sheet feeding apparatus 201 starts to feed a sheet to the image forming apparatus 101 in response to a feed request for instructing to start the feeding of the sheet, which is output from the image forming apparatus 101. The first sheet feeding apparatus 201 includes a sheet feeding unit 30 for receiving a plurality of sheets, the conveyance path 39 for conveying a sheet from the sheet feeding unit 30 to the outside of the first sheet feeding apparatus 201, and different kinds of rollers and a sensor that are provided along the conveyance path 39. On the conveyance path 39, there are provided separation feeding portions 31 and 32 including a pickup roller, vertical path rollers 33, conveyance roller pairs 34 and 35, discharge rollers 36, and a horizontal path conveyance sensor 37.

The sheets received in the sheet feeding unit 30 are sent to the conveyance path 39 by the separation feeding portions 31 and 32 one by one in response to the feed request output from the image forming apparatus 101. The vertical path rollers 33 and the conveyance roller pairs 34 and 35 convey the sheet sent to the conveyance path 39 by the separation feeding portions 31 and 32. The sheet conveyed on the conveyance path 39 is detected by the horizontal path conveyance sensor 37. The conveyance of the sheet is temporarily stopped with a trigger of the detection of the sheet performed by the horizontal path conveyance sensor 37.

The first sheet feeding apparatus 201 restarts the conveyance of the sheet stopped on the conveyance path 39 in response to a delivery request for instructing the delivery of the sheet, which is output from the image forming apparatus 101, and discharges the sheet to the outside of the first sheet feeding apparatus 201 by the discharge rollers 36 to deliver the sheet to the apparatus (image forming apparatus 101) provided on the downstream side. When the sheets are successively supplied to the apparatus on the downstream side, in order to prevent the sheets from colliding with each other, the first sheet feeding apparatus 201 starts the conveyance of the next sheet after restarting the conveyance of the sheet temporarily stopped on the conveyance path 39.

The second sheet feeding apparatus 301 starts to feed the sheet to the image forming apparatus 101 in response to the feed request output from the image forming apparatus 101. The second sheet feeding apparatus 301 includes a sheet feeding unit 40 for receiving a plurality of sheets, the conveyance path 47 for conveying a sheet from the sheet feeding unit 40 to the outside of the second sheet feeding apparatus 301, and various rollers provided along the conveyance path 47. On the conveyance path 47, there are provided separation feeding portions 41 and 42 including a pickup roller, vertical path rollers 43, conveyance roller pairs 44 and 45, and discharge rollers 46.

The sheets received in the sheet feeding unit 40 are sent to the conveyance path 47 by the separation feeding portions 41 and 42 one by one in response to the feed request output from the image forming apparatus 101. The vertical path rollers 43 and the conveyance roller pairs 44 and 45 convey the sheet sent to the conveyance path 47 by the separation feeding portions 41 and 42. The discharge rollers 46 discharge the sheet conveyed along the conveyance path 47 to the outside of the second sheet feeding apparatus 301 to deliver the sheet to the apparatus (image forming apparatus 101) provided on the downstream side.

The sheet conveying apparatus 401 includes conveyance rollers 50 and 51, discharge rollers 52, and a horizontal path conveyance sensor 53 along the conveyance path 55. The sheet conveying apparatus 401 takes in the sheet discharged from the apparatus (second sheet feeding apparatus 301) connected on the upstream side by the conveyance rollers 50 via a taking-in portion 54. The taken-in sheet is conveyed along the conveyance path 55 by the conveyance rollers 50 and 51. The sheet being conveyed along the conveyance path 55 is detected by the horizontal path conveyance sensor 53. The conveyance of the sheet is temporarily stopped with a trigger of the detection of the sheet performed by the horizontal path conveyance sensor 53.

The sheet conveying apparatus 401 restarts the conveyance of the sheet in response to the delivery request output from the image forming apparatus 101, and discharges the sheet to the outside of the sheet conveying apparatus 401 by the discharge rollers 52 to deliver the sheet to the apparatus (image forming apparatus 101) provided on the downstream side.

(Control System)

Figure 2A:
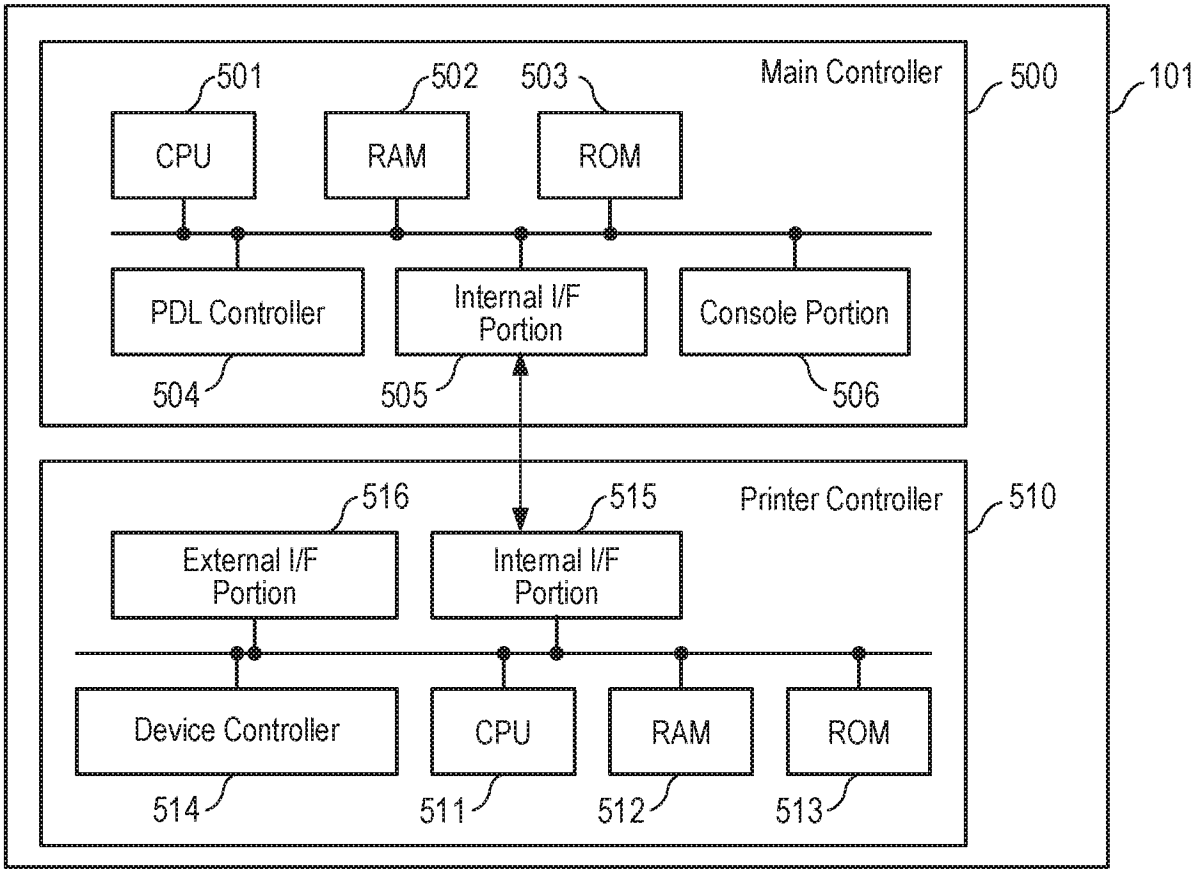
FIG. 2A, FIG. 2B, FIG. 2C, and FIG. 2D are diagrams for illustrating examples of configurations of a control system of the image forming system.
Figure 2B:
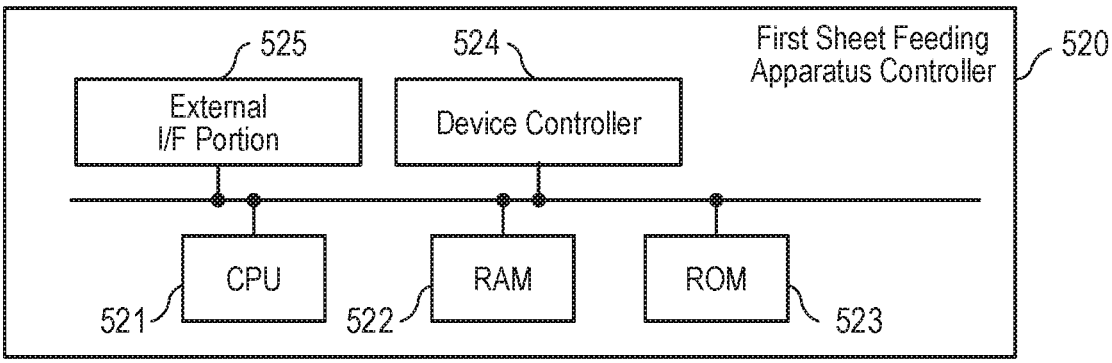
Figure 2C:
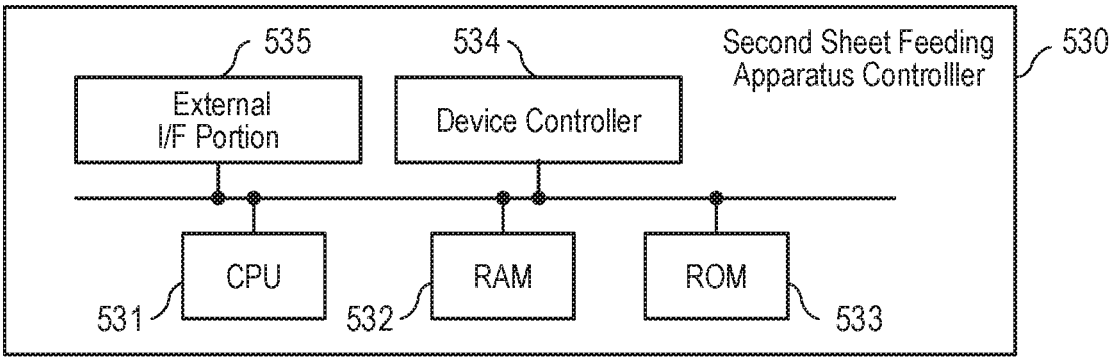
Figure 2D:
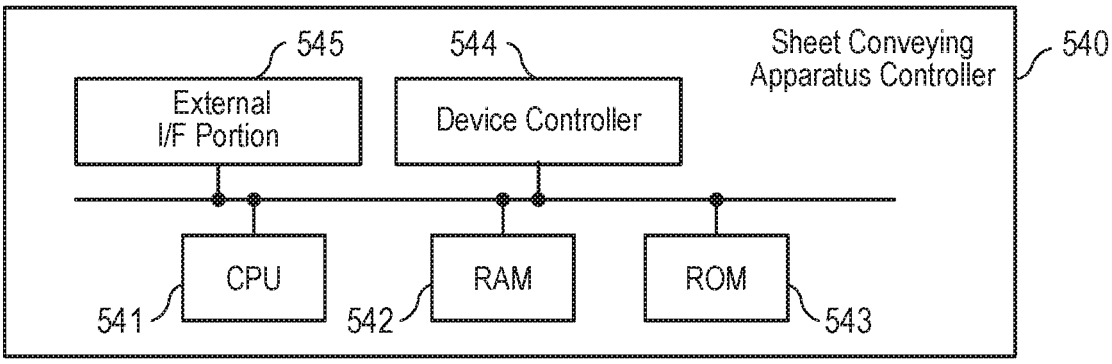

FIG. 2A, FIG. 2B, FIG. 2C, and FIG. 2D are diagrams for illustrating examples of configurations of a control system of the image forming system 1. The image forming apparatus 101 has the operation controlled by a main controller 500 and a printer controller 510 as illustrated in FIG. 2A. The first sheet feeding apparatus 201 has the operation controlled by a first sheet feeding apparatus controller 520 as illustrated in FIG. 2B. The second sheet feeding apparatus 301 has the operation controlled by a second sheet feeding apparatus controller 530 as illustrated in FIG. 2C. The sheet conveying apparatus 401 has the operation controlled by a sheet conveying apparatus controller 540 as illustrated in FIG. 2D.

The main controller 500 is a computer including a central processing unit (CPU) 501, a random access memory (RAM) 502, and a read only memory (ROM) 503. The main controller 500 further includes a page-description language (PDL) controller 504, an internal I/F portion 505, and a console portion 506. The CPU 501 reads a computer program from the ROM 503, and uses the RAM 502 as a work area to execute the computer program, to thereby cause the main controller 500 to perform various kinds of processing. The PDL controller 504 processes and accumulates image data to be used for image formation, and performs image processing thereon. The internal I/F portion 505 is a communication interface configured to enable communication with the printer controller 510. The console portion 506 is a user interface configured to receive an instruction from a user and to present various kinds of information to the user.

The printer controller 510 is a computer including a CPU 511, a RAM 512, and a ROM 513. The printer controller 510 further includes a device controller 514, an internal I/F portion 515, and an external I/F portion 516. The CPU 511 reads a computer program from the ROM 513, and uses the RAM 512 as a work area to execute the computer program, to thereby control the operation of the image forming apparatus 101. In particular, in this embodiment, the CPU 511 determines timings to send the feed request and the delivery request to the sheet supplying mechanism 102 based on the type of the apparatus constructing the sheet supplying mechanism 102.

The device controller 514 controls the operations of the respective components of the image forming apparatus 101 under the control of the CPU 511. The internal I/F portion 515 is a communication interface configured to enable communication with the main controller 500. The internal I/F portion 515 sends and receives image data and a timing signal to/from the main controller 500. Such a configuration enables the CPU 511 to perform image forming processing by controlling the device controller 514 based on the image data obtained from the main controller 500 by the internal I/F portion 515. The external I/F portion 516 is a communication interface with the apparatus constructing the sheet supplying mechanism 102. The external I/F portion 516 is controlled by the CPU 511 to send the feed request and the delivery request for a sheet to the apparatus constructing the sheet supplying mechanism 102, and receives the apparatus ID from the apparatus constructing the sheet supplying mechanism 102. That is, the external I/F portion 516 functions as an obtaining device configured to obtain the apparatus ID.

The first sheet feeding apparatus controller 520 is a computer including a CPU 521, a RAM 522, and a ROM 523. The first sheet feeding apparatus controller 520 further includes a device controller 524 and an external I/F portion 525. The CPU 521 reads a computer program from the ROM 523, and uses the RAM 522 as a work area to execute the computer program, to thereby control the operation of the first sheet feeding apparatus 201. The device controller 524 controls the operations of the respective components of the first sheet feeding apparatus 201 under the control of the CPU 521. The external I/F portion 525 is a communication interface with the image forming apparatus 101. The external I/F portion 525 receives the feed request and the delivery request for a sheet from the image forming apparatus 101, and is controlled by the CPU 521 to send the apparatus ID to the image forming apparatus 101. The apparatus ID is stored in, for example, the ROM 523 in advance.

The second sheet feeding apparatus controller 530 is a computer including a CPU 531, a RAM 532, and a ROM 533. The second sheet feeding apparatus controller 530 further includes a device controller 534 and an external I/F portion 535. The CPU 531 reads a computer program from the ROM 533, and uses the RAM 532 as a work area to execute the computer program, to thereby control the operation of the second sheet feeding apparatus 301. The device controller 534 controls the operations of the respective components of the second sheet feeding apparatus 301 under the control of the CPU 531. The external I/F portion 535 is a communication interface with the image forming apparatus 101. The external I/F portion 535 receives the feed request and the delivery request for a sheet from the image forming apparatus 101, and is controlled by the CPU 531 to send the apparatus ID to the image forming apparatus 101. The apparatus ID is stored in, for example, the ROM 533 in advance.

The sheet conveying apparatus controller 540 is a computer including a CPU 541, a RAM 542, and a ROM 543. The sheet conveying apparatus controller 540 further includes a device controller 544 and an external I/F portion 545. The CPU 541 reads a computer program from the ROM 543, and uses the RAM 542 as a work area to execute the computer program, to thereby control the operation of the sheet conveying apparatus controller 540. The device controller 544 controls the operations of the respective components of the sheet conveying apparatus controller 540 under the control of the CPU 541. The external I/F portion 545 is a communication interface with the image forming apparatus 101. The external I/F portion 545 receives the delivery request for a sheet from the image forming apparatus 101, and is controlled by the CPU 541 to send the apparatus ID to the image forming apparatus 101. The apparatus ID is stored in, for example, the ROM 543 in advance.

In the image forming system 1 configured as described above, the image forming apparatus 101 determines a timing to feed the sheet from the sheet supplying mechanism 102 based on the apparatus constructing the sheet supplying mechanism 102, a conveyance speed of the sheet, and a timing for image formation. Specifically, the CPU 511 of the image forming apparatus 101 calculates a distance by which the sheet is conveyed from the conveyance path in the apparatus constructing the sheet supplying mechanism 102 to the secondary transfer portion 21 along the horizontal path 15 in the image forming apparatus 101. The CPU 511 of the image forming apparatus 101 calculates a time period required for forming images on the photosensitive drums 22 to 25 and carrying the images to the secondary transfer portion 21. The CPU 511 of the image forming apparatus 101 calculates a conveyance speed of the sheet in the apparatus constructing the sheet supplying mechanism 102 and a conveyance speed of the sheet in the image forming apparatus 101.

The CPU 511 of the image forming apparatus 101 determines the timings to send the feed request and the delivery request to the sheet supplying mechanism 102 based on the conveyance distance of the sheet, the conveyance speed of the sheet, and the time period required for forming images and carrying the images to the secondary transfer portion 21, which have been calculated. To that end, the image forming apparatus 101 stores, for each type of the apparatus constructing the sheet supplying mechanism 102, information for calculating a sheet conveyance time required for the sheet to be conveyed in the corresponding apparatus, for example, the conveyance distance by which the sheet is conveyed in the corresponding apparatus and the conveyance speed at which the sheet is conveyed in the corresponding apparatus, in the ROM 513. The ROM 513 may store, for each type of the apparatus constructing the sheet supplying mechanism 102, the sheet conveyance time itself required for the sheet to be conveyed in the corresponding apparatus.

(Operation Mode 1)

Figure 3:
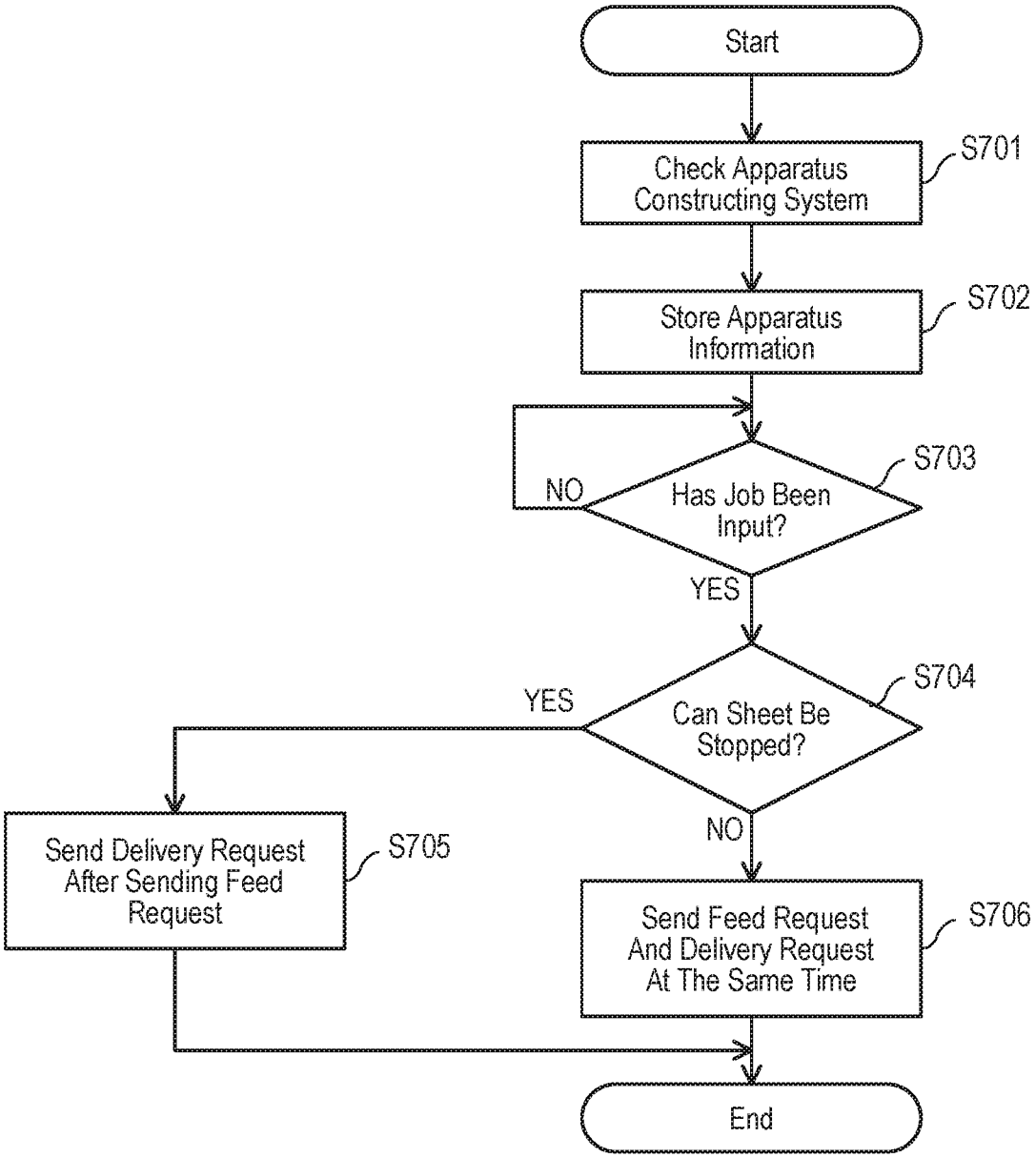
FIG. 3 is a flow chart for illustrating an operation performed when an image forming apparatus takes in a sheet.

FIG. 3 is a flow chart for illustrating an operation performed when the image forming apparatus 101 takes in a sheet from the sheet supplying mechanism 102 in the image forming system 1 having the configuration of FIG. 1A or FIG. 1B.

The image forming apparatus 101 first checks an apparatus constructing the image forming system 1 (Step S701). Specifically, the image forming apparatus 101 checks which one of the sheet supplying mechanisms 102 illustrated in FIG. 1A, FIG. 1B, and FIG. 1C is included in the image forming system 1. To that end, the CPU (controller) 511 of the image forming apparatus 101 obtains the apparatus ID from the apparatus constructing the sheet supplying mechanism 102 by the external I/F portion 516. For example, the apparatus ID is set to "1" for the first sheet feeding apparatus 201, "2" for the second sheet feeding apparatus 301, and "3" for the sheet conveying apparatus 401. The CPU 511 can use the obtained apparatus ID to check the entire configuration of the image forming system 1. In the case of the configuration of FIG. 1A, the CPU 511 obtains the apparatus ID of "1". In the case of the configuration of FIG. 1B, the CPU 511 obtains the apparatus ID of "2".

The CPU 511 stores apparatus information representing the type of the apparatus constructing the sheet supplying mechanism 102 in a predetermined memory area of the RAM (storage) 512 (Step S702). The apparatus information to be stored may be the apparatus ID itself, and may also be a value set based on the type of the apparatus. In this embodiment, the apparatus information is set to "0" for the sheet feeding apparatus capable of temporarily stopping the conveyance of the sheet in the apparatus, "1" for the sheet feeding apparatus incapable of temporarily stopping the conveyance of the sheet in the apparatus, and "2" for the sheet conveying apparatus. The CPU 511 stores the apparatus information item of "0" in the RAM 512 when obtaining the apparatus ID of "1", and stores the apparatus information item of "1" in the RAM 512 when obtaining the apparatus ID of "2". The above-mentioned processing is performed at the time of, for example, the set-up of the image forming system 1. The apparatus information is associated with the information for calculating the sheet conveyance time required in each of the first sheet feeding apparatus 201, the second sheet feeding apparatus 301, and the sheet conveying apparatus 401, the information being stored in the ROM 513. The CPU 511 can identify the apparatus information to obtain the information for calculating the sheet conveyance time from the ROM 513.

The image forming apparatus 101 determines whether or not a print job has been input (Step S703). The print job is input by, for example, the console portion 506. The CPU 511 receives the print job input from the console portion 506 via the internal I/F portions 505 and 515. When the print job has not been input (NO in Step S703), the CPU 511 stands by until the print job is input. When the print job has been input (YES in Step S703), the CPU 511 refers to the apparatus information stored in the RAM 512 to check the type of the apparatus constructing the sheet supplying mechanism 102 instructed to supply the sheet by the received print job. Specifically, the CPU 511 checks whether or not the sheet supplying mechanism 102 is a sheet feeding apparatus capable of temporarily stopping the conveyance of the sheet (Step S704). That is, the CPU 511 checks whether or not the apparatus information includes "0".

When the apparatus information includes "0" and the print job includes an instruction to feed the sheet from the first sheet feeding apparatus 201 (YES in Step S704), the CPU 511 reads the information for calculating the sheet conveyance time required in the first sheet feeding apparatus 201 from the ROM 513 to determine the timings to send the feed request and the delivery request. The CPU 511 first sends the feed request to the first sheet feeding apparatus 201, and then sends the delivery request for the sheet to the first sheet feeding apparatus 201 after the lapse of a predetermined time, based on the determined timings (Step S705). When the apparatus information does not include "0" and the print job includes an instruction to feed the sheet from the second sheet feeding apparatus 301 (NO in Step S704), the CPU 511 reads the information for calculating the sheet conveyance time required in the second sheet feeding apparatus 301 from the ROM 513 to determine the timings to send the feed request and the delivery request. The CPU 511 sends the feed request and the delivery request to the second sheet feeding apparatus 301 substantially simultaneously at a timing to take in the sheet, which is already being conveyed, from the taking-in portion 17 based on the determined timings (Step S706). Specifically, the CPU 511 successively sends the delivery request and the feed request to the second sheet feeding apparatus 301. The above-mentioned processing enables the image forming apparatus 101 to obtain a sheet from the first sheet feeding apparatus 201 or the second sheet feeding apparatus 301, which is connected on the upstream side, to perform the image forming processing on the sheet.

Figure 4A:
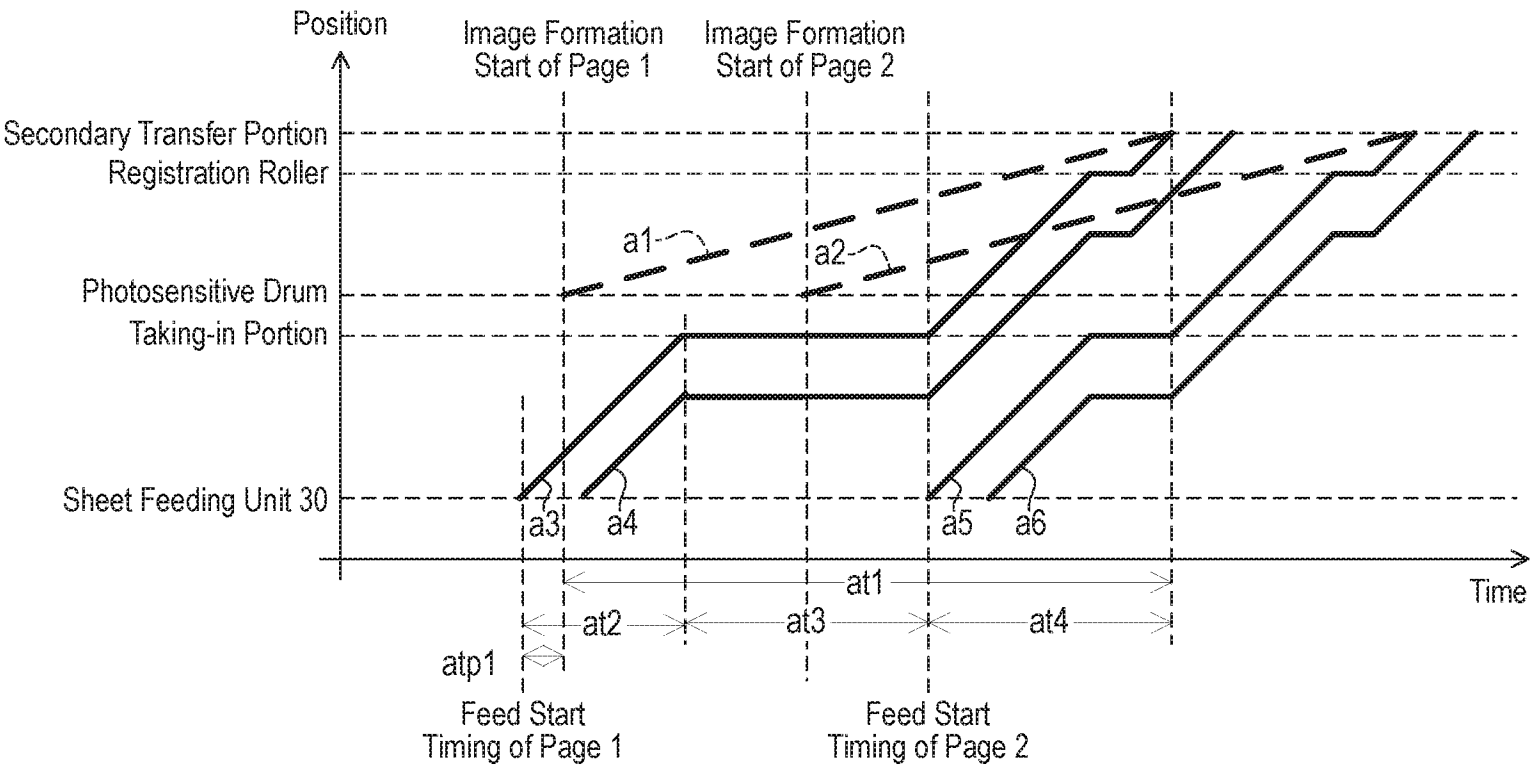
FIG. 4A and FIG. 4B are timing charts obtained at the time of sheet feeding.
Figure 4B:
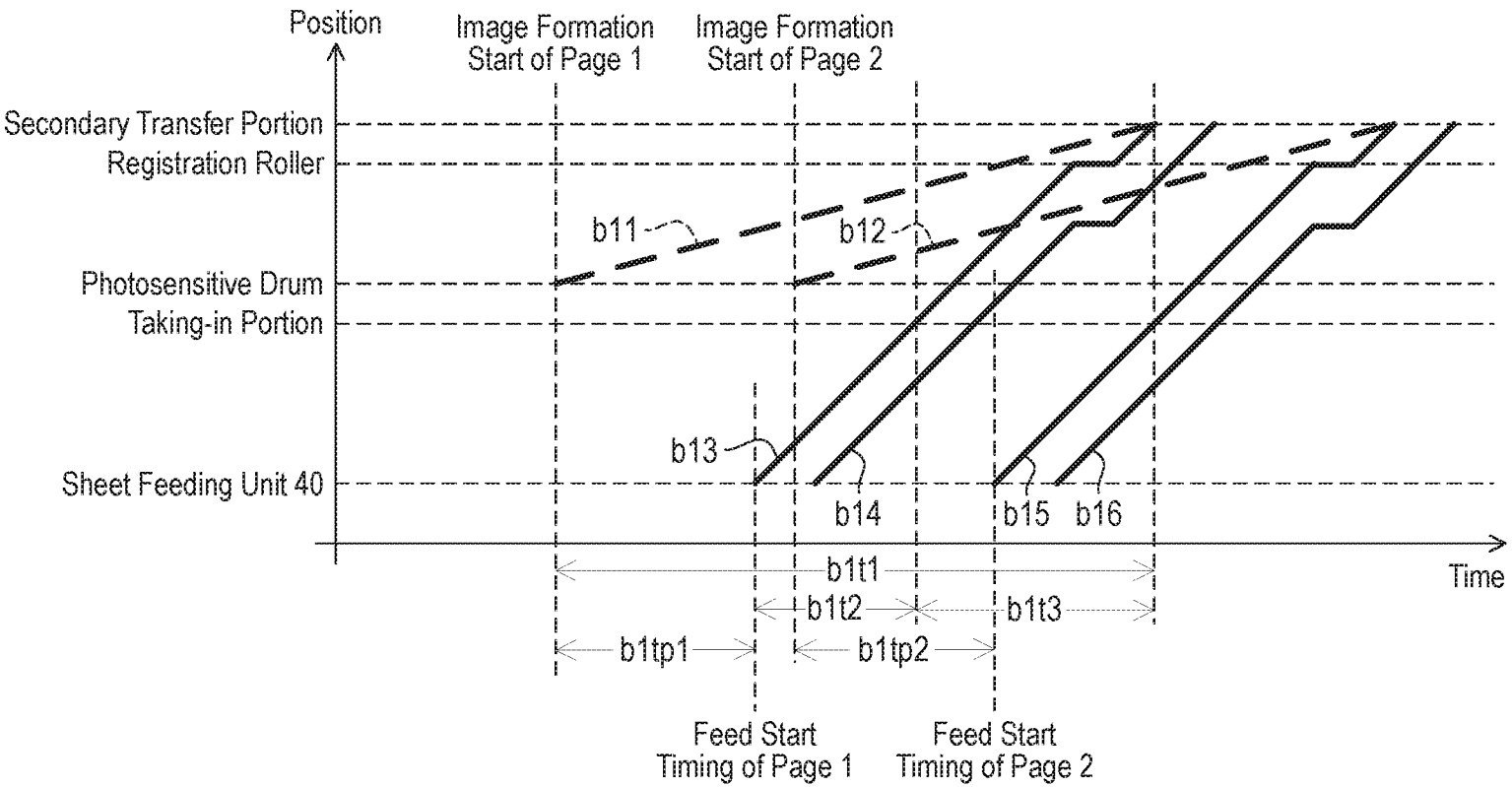

FIG. 4A and FIG. 4B are timing charts obtained at the time of sheet feeding performed in the configurations of FIG. 1A and FIG. 1B, respectively. In FIG. 4A and FIG. 4B, timings obtained at respective conveyance positions of sheets in a case where images are formed on two sheets are shown.

FIG. 4A is the timing chart for the image forming system 1 having the configuration of FIG. 1A. At the time of processing of Step S705, the operations are performed at timings of FIG. 4A. In FIG. 4A, the line indicated by "a1" represents the leading edge position of an image to be transferred onto the sheet of the first page (page 1) formed on the photosensitive drum 22. The line indicated by "a2" represents the leading edge position of an image to be transferred onto the sheet of the second page (page 2) formed on the photosensitive drum 22. The image formed on the photosensitive drum 22 is carried to the secondary transfer portion 21 at a constant speed via the intermediate transfer member 26. A time period required for carrying the image formed on the photosensitive drum 22 to the secondary transfer portion 21 is "at1". The image forming processing is performed at a given time interval.

The line indicated by "a3" represents the leading edge position of the sheet (sheet of the first page), onto which the image of the first page (page 1) is to be transferred, in the conveyance direction. The line indicated by "a4" represents the trailing edge position of the sheet of the first page in the conveyance direction. The first sheet feeding apparatus 201 receives the feed request from the image forming apparatus 101, and starts to feed the sheet of the first page. The sheet fed from the sheet feeding unit 30 of the first sheet feeding apparatus 201 stops being conveyed at a position immediately before a position at which the leading edge reaches the taking-in portion 17 of the image forming apparatus 101 based on a detection result obtained by the horizontal path conveyance sensor 37. A time period required for the leading edge of the sheet being conveyed from the sheet feeding unit 30 to reach the position immediately before the position at which the sheet reaches the taking-in portion 17 is "at2". A time period for which the conveyance of the sheet is being stopped at the position immediately before the position at which the sheet reaches the taking-in portion 17 is "at3". When receiving the delivery request for the sheet from the image forming apparatus 101, the first sheet feeding apparatus 201 restarts the conveyance of the sheet, which has been stopped, to deliver the sheet to the image forming apparatus 101.

The conveyance of the sheet of the first page taken into the image forming apparatus 101 is stopped with the leading edge being brought into abutment with the registration rollers 12, and is then restarted to convey the sheet to the secondary transfer portion 21. A time period required after the sheet of the first page is delivered until the leading edge of the sheet of the first page has been conveyed to the secondary transfer portion 21 is "at4".

The line indicated by "a5" represents the leading edge position of the sheet (sheet of the second page), onto which the image of the second page (page 2) is to be transferred, in the conveyance direction. The line indicated by "a6" represents the trailing edge position of the sheet of the second page in the conveyance direction. The first sheet feeding apparatus 201 receives the delivery request for the sheet of the first page from the image forming apparatus 101, and then starts to feed the sheet of the second page. Timings after the feeding of the sheet of the second page are substantially the same as those for the sheet of the first page except for a time period for which the conveyance of the sheet is being stopped at the position immediately before the position at which the sheet reaches the taking-in portion 17. The time period for which the conveyance of the sheet of the second page is being stopped at the position immediately before the position at which the sheet reaches the taking-in portion 17 is a difference between the time "at4" and the time "at2".

The feed start timing of the sheet of the first page is earlier than the image formation start timing of the image to be formed on the sheet of the first page by a time "atp1". The time "atp1" is expressed by "at1−(at4+at3+at2)". In this case, a time period at3 for which the sheet of the first page is kept standing by at the position immediately before the taking-in portion 17 has a value equal to or larger than zero. That is, the image forming apparatus 101 sends the feed request to the first sheet feeding apparatus 201 at a timing calculated back from the timing at which the images are carried to the secondary transfer portion 21. The feed start timing of the sheet of the second page is a timing at which the sheet that has temporarily stopped being conveyed on the conveyance path 39 is delivered to the image forming apparatus 101. The image forming apparatus 101 sends the feed request for the sheet of the second page simultaneously with or before the sending of the delivery request for the sheet of the first page. The image forming apparatus 101 also sends the feed request for the sheet of each of the third page and the subsequent pages to the first sheet feeding apparatus 201 simultaneously with or before the sending of the delivery request for the sheet of the previous page. The first sheet feeding apparatus 201 starts to feed the sheet of each of the second page and the subsequent pages with the reception of the feed request and the delivery request as a trigger. The feed request is sent in the above-mentioned manner, to thereby prevent two or more sheets from being conveyed on the conveyance path at the same timing. The delivery request is sent to the first sheet feeding apparatus 201 at a timing earlier than the timing at which the images are carried to the secondary transfer portion 21 by a time period required for the supplied sheet to be conveyed to the secondary transfer portion 21 in the image forming apparatus 101.

FIG. 4B is the timing chart for the image forming system 1 having the configuration of FIG. 1B. At the time of processing of Step S706, the operations are performed at timings of FIG. 4B. In FIG. 4B, the line indicated by "b11" represents the leading edge position of an image to be transferred onto the sheet of the first page (page 1) formed on the photosensitive drum 22. The line indicated by "b12" represents the leading edge position of an image to be transferred onto the sheet of the second page (page 2) formed on the photosensitive drum 22. The image formed on the photosensitive drum 22 is carried to the secondary transfer portion 21 at a constant speed via the intermediate transfer member 26. A time period required for carrying the image formed on the photosensitive drum 22 to the secondary transfer portion 21 is "b1t1". The image forming processing is performed at a given time interval.

The line indicated by "b13" represents the leading edge position of the sheet (sheet of the first page), onto which the image of the first page (page 1) is to be transferred, in the conveyance direction. The line indicated by "b14" represents the trailing edge position of the sheet of the first page in the conveyance direction. The second sheet feeding apparatus 301 receives the feed request from the image forming apparatus 101, and starts to feed the sheet of the first page. A time period required for the leading edge of the sheet fed from the sheet feeding unit 40 of the second sheet feeding apparatus 301 to reach the taking-in portion 17 of the image forming apparatus 101 is "b1t2". The image forming apparatus 101 sends the delivery request for the sheet to the second sheet feeding apparatus 301 simultaneously with a timing at which the second sheet feeding apparatus 301 causes the leading edge of the sheet to reach the taking-in portion 17 of the image forming apparatus 101.

Immediately after the conveyance of the sheet of the first page taken into the image forming apparatus 101 is stopped with the leading edge being brought into abutment with the registration rollers 12, the conveyance is restarted to convey the sheet to the secondary transfer portion 21. A time period required after the sheet of the first page is delivered until the leading edge of the sheet of the first page has been conveyed to the secondary transfer portion 21 is "b1t3".

The line indicated by "b15" represents the leading edge position of the sheet (sheet of the second page), onto which the image of the second page (page 2) is to be transferred, in the conveyance direction. The line indicated by "b16" represents the trailing edge position of the sheet of the second page in the conveyance direction. In the same manner as in the case of the sheet of the first page, the image forming apparatus 101 sends the delivery request for the sheet of the second page simultaneously with a timing at which the second sheet feeding apparatus 301 causes the leading edge of the sheet of the second page to reach the taking-in portion 17. The movement of the sheet of the second page in the image forming apparatus 101 is the same as that of the sheet of the first page.

The feed start timing of the sheet of the first page is later than the image formation start timing of the image to be formed on the sheet of the first page by a time "b1tp1". The time "b1tp1" is expressed by "b1t1−(b1t2+b1t3)". The feed start timing of the sheet of the second page is later than the image formation start timing of the image to be formed on the sheet of the second page by a time "b1tp2". The time "b1tp2" has the same value as that of the time "b1tp1". That is, the image forming apparatus 101 sends the feed request to the second sheet feeding apparatus 301 at the timing calculated back from the timing at which the images are carried to the secondary transfer portion 21. The image forming apparatus 101 sends the feed request to the second sheet feeding apparatus 301 at each of the feed timings.

In the respective timing charts of FIG. 4A and FIG. 4B, the conveyance speeds of the sheet are the same in each of the image forming apparatus 101, the first sheet feeding apparatus 201, and the second sheet feeding apparatus 301. In addition, the distance of the conveyance path from the sheet feeding unit 30 to the taking-in portion 17 is the same as the distance of the conveyance path from the sheet feeding unit 40 to the taking-in portion 17. In this case, the sheet conveyance time is "at2+at3+at4" in FIG. 4A, and is "b1t2+b1t3" in FIG. 4B. Therefore, the second sheet feeding apparatus 301 can convey the sheet in a shorter period by the time period (at3) for which the conveyance of the sheet is being stopped.

(Operation Mode 2)

Figure 5:
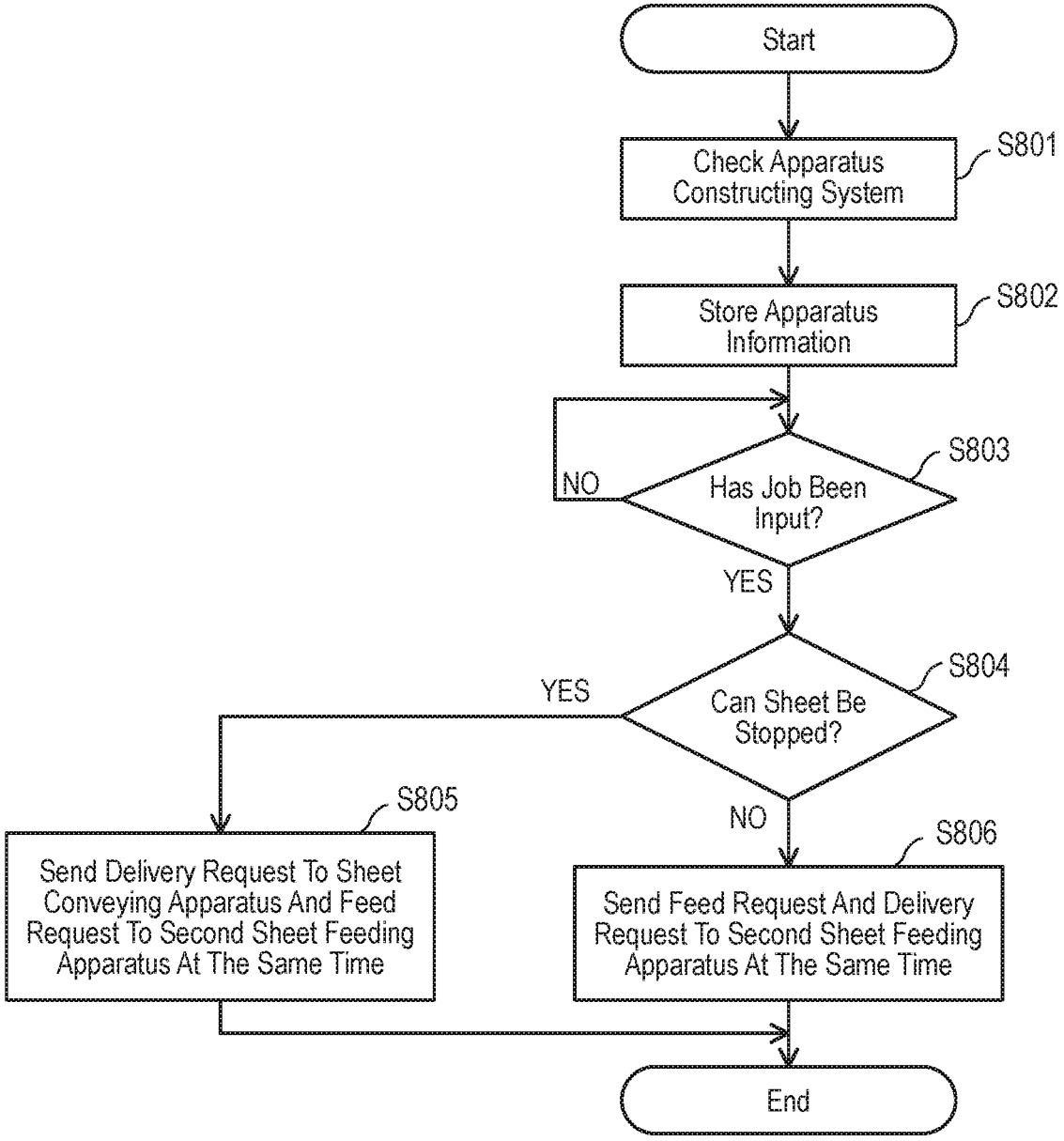
FIG. 5 is a flow chart for illustrating an operation performed when the image forming apparatus takes in a sheet.

FIG. 5 is a flow chart for illustrating an operation performed when the image forming apparatus 101 takes in a sheet from the sheet supplying mechanism 102 in the image forming system 1 having the configuration of FIG. 1B or FIG. 1C.

The image forming apparatus 101 checks an apparatus constructing the image forming system 1 (Step S801). Specifically, the image forming apparatus 101 checks which one of the sheet supplying mechanisms 102 illustrated in FIG. 1A, FIG. 1B, and FIG. 1C is included in the image forming system 1. To that end, the CPU (controller) 511 of the image forming apparatus 101 obtains the apparatus ID from the apparatus constructing the sheet supplying mechanism 102 by the external I/F portion 516. For example, the apparatus ID is set to "1" for the first sheet feeding apparatus 201, "2" for the second sheet feeding apparatus 301, and "3" for the sheet conveying apparatus 401. The CPU 511 can use the obtained apparatus ID to check the entire configuration of the image forming system 1. In the case of the configuration of FIG. 1B, the CPU 511 obtains the apparatus ID of "2". In the case of the configuration of FIG. 1C, the CPU 511 obtains the apparatus IDs of "2" and "3". In the case of the configuration of FIG. 1C, the CPU 511 obtains the apparatus IDs in order from, for example, the most upstream apparatus or the most downstream apparatus among apparatus connected on the upstream side of the image forming apparatus 101. The CPU 511 obtains the apparatus IDs in this manner, to thereby be able to check in what order the apparatus are connected on the upstream side.

The CPU 511 stores apparatus information representing the type of the apparatus constructing the sheet supplying mechanism 102 in a predetermined memory area of the RAM (storage) 512 (Step S802). The apparatus information to be stored may be the apparatus ID itself, and may also be a value set based on the type of the apparatus. In this embodiment, the apparatus information is set to "0" for the sheet feeding apparatus capable of temporarily stopping the conveyance of the sheet in the apparatus, "1" for the sheet feeding apparatus incapable of temporarily stopping the conveyance of the sheet in the apparatus, and "2" for the sheet conveying apparatus. The CPU 511 stores the apparatus information item of "1" in the RAM 512 when obtaining the apparatus ID of "2", and stores the apparatus information item of "2" in the RAM 512 when obtaining the apparatus ID of "3". In the configuration of FIG. 1B, the apparatus information item of "1" is stored in the RAM 512, and in the configuration of FIG. 1C, the apparatus information items of "1" and "2" are stored in the RAM 512. The above-mentioned processing is performed at the time of, for example, the set-up of the image forming system 1. The apparatus information is associated with the information for calculating the sheet conveyance time required in each of the first sheet feeding apparatus 201, the second sheet feeding apparatus 301, and the sheet conveying apparatus 401, the information being stored in the ROM 513. The CPU 511 can identify the apparatus information to obtain the information for calculating the sheet conveyance time from the ROM 513.

The image forming apparatus 101 determines whether or not a print job has been input (Step S803). The print job is input by, for example, the console portion 506. The CPU 511 receives the print job input from the console portion 506 via the internal I/F portions 505 and 515. When the print job has not been input (NO in Step S803), the CPU 511 stands by until the print job is input. When the print job has been input (YES in Step S803), the CPU 511 refers to the apparatus information stored in the RAM 512 to check the configuration of the sheet supplying mechanism 102 instructed to supply the sheet by the received print job. Specifically, the CPU 511 checks whether or not the sheet supplying mechanism 102 is capable of temporarily stopping the conveyance of the sheet (Step S804). That is, the CPU 511 checks whether or not the apparatus information includes "2".

When the apparatus information includes "2" and the print job includes an instruction to feed the sheet from the second sheet feeding apparatus 301 (YES in Step S804), the CPU 511 reads the information for calculating the sheet conveyance time required in each of the second sheet feeding apparatus 301 and the sheet conveying apparatus 401 from the ROM 513 to determine the timings to send the feed request and the delivery request. The CPU 511 sends the delivery request for the sheet conveying apparatus 401 and the feed request for the second sheet feeding apparatus 301 at substantially the same timing based on the determined timings (Step S805). When the apparatus information does not include "2" and the print job includes the instruction to feed the sheet from the second sheet feeding apparatus 301 (NO in Step S804), the CPU 511 determines that the second sheet feeding apparatus 301 is connected on the upstream side without the intermediation of the sheet conveying apparatus 401. The CPU 511 reads the information for calculating the sheet conveyance time required in the second sheet feeding apparatus 301 from the ROM 513 to determine the timings to send the feed request and the delivery request. The CPU 511 performs the same processing step as Step S706 of FIG. 3 based on the determined timings (Step S806). The above-mentioned processing enables the image forming apparatus 101 to obtain a sheet from the second sheet feeding apparatus 301 connected on the upstream side, or from the second sheet feeding apparatus 301 via the sheet conveying apparatus 401, to perform the image forming processing on the sheet.

Figure 6A:
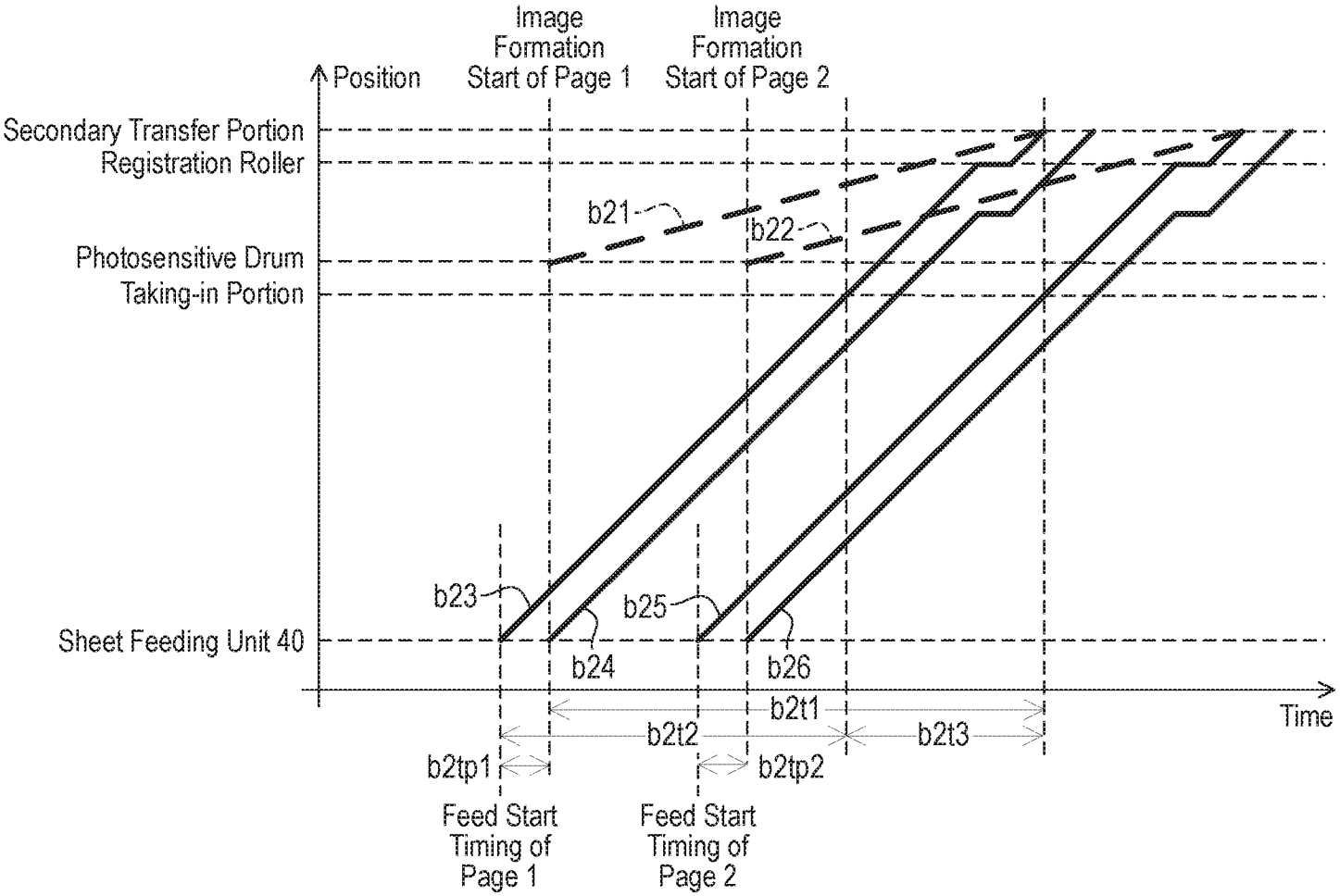
FIG. 6A and FIG. 6B are timing charts obtained at the time of sheet feeding.
Figure 6B:
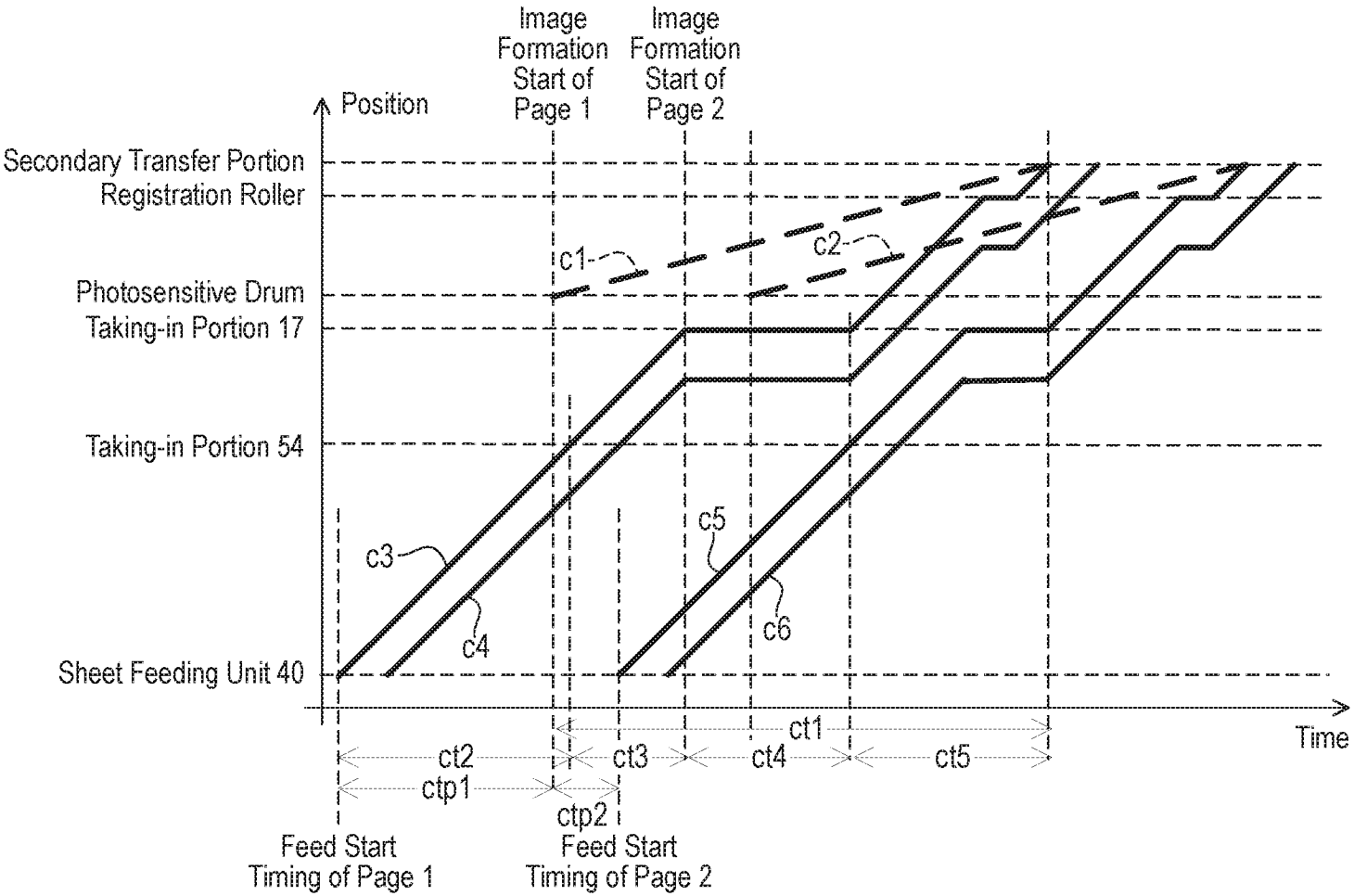

FIG. 6A and FIG. 6B are timing charts obtained at the time of sheet feeding performed in the configurations of FIG. 1B and FIG. 1C, respectively. In FIG. 6A and FIG. 6B, timings obtained at respective conveyance positions of sheets in a case where images are formed on two sheets are shown.

FIG. 6A is the timing chart for the image forming system 1 having the configuration of FIG. 1B. At the time of processing of Step S806, the operations are performed at timings of FIG. 6A. In the second sheet feeding apparatus 301 described with reference to the timing chart of FIG. 6A, the length of the conveyance path is assumed to be the same as a length obtained by adding the lengths of the conveyance paths 47 and 55 of the second sheet feeding apparatus 301 and the sheet conveying apparatus 401, respectively, of FIG. 1C. This clarifies a difference in feed timing due to a difference in configuration between FIG. 1B and FIG. 1C.

In FIG. 6A, the line indicated by "b21" represents the leading edge position of an image to be transferred onto the sheet of the first page (page 1) formed on the photosensitive drum 22. The line indicated by "b22" represents the leading edge position of an image to be transferred onto the sheet of the second page (page 2) formed on the photosensitive drum 22. The image formed on the photosensitive drum 22 is carried to the secondary transfer portion 21 at a constant speed via the intermediate transfer member 26. A time period required for carrying the image formed on the photosensitive drum 22 to the secondary transfer portion 21 is "b2t1". The image forming processing is performed at a given time interval.

The line indicated by "b23" represents the leading edge position of the sheet (sheet of the first page), onto which the image of the first page (page 1) is to be transferred, in the conveyance direction. The line indicated by "b24" represents the trailing edge position of the sheet of the first page in the conveyance direction. The second sheet feeding apparatus 301 receives the feed request from the image forming apparatus 101, and starts to feed the sheet of the first page. A time period required for the leading edge of the sheet fed from the sheet feeding unit 40 of the second sheet feeding apparatus 301 to reach the taking-in portion 17 of the image forming apparatus 101 is "b2t2". The image forming apparatus 101 sends the delivery request for the sheet to the second sheet feeding apparatus 301 simultaneously with the timing at which the second sheet feeding apparatus 301 causes the leading edge of the sheet to reach the taking-in portion 17 of the image forming apparatus 101.

The conveyance of the sheet of the first page taken into the image forming apparatus 101 is stopped with the leading edge being brought into abutment with the registration rollers 12, and is then immediately restarted to convey the sheet to the secondary transfer portion 21. A time period required after the sheet is delivered until the leading edge of the sheet has been conveyed to the secondary transfer portion 21 is "b2t3".

The line indicated by "b25" represents the leading edge position of the sheet (sheet of the second page), onto which the image of the second page (page 2) is to be transferred, in the conveyance direction. The line indicated by "b26" represents the trailing edge position of the sheet of the second page in the conveyance direction. In the same manner as in the case of the sheet of the first page, the image forming apparatus 101 sends the delivery request for the sheet of the second page simultaneously with the timing at which the second sheet feeding apparatus 301 causes the leading edge of the sheet of the second page to reach the taking-in portion 17 of the image forming apparatus 101. The movement of the sheet of the second page in the image forming apparatus 101 is the same as that of the sheet of the first page.

The feed start timing of the sheet of the first page is earlier than the image formation start timing of the image to be formed on the sheet of the first page by a time "b2tp1". The time "b2tp1" is expressed by "b2t1−(b2t2+b2t3)". The feed start timing of the sheet of the second page is earlier than the image formation start timing of the image to be formed on the sheet of the second page by a time "b2tp2". The time "b2tp2" has the same value as that of the time "b2tp1". That is, the image forming apparatus 101 sends the feed request to the second sheet feeding apparatus 301 at a timing calculated back from the timing at which the images are carried to the secondary transfer portion 21. The image forming apparatus 101 sends the feed request to the second sheet feeding apparatus 301 at each of the feed start timings.

FIG. 6B is the timing chart for the image forming system 1 having the configuration of FIG. 1C. At the time of processing of Step S805, the operations are performed at timings of FIG. 6B. In FIG. 6B, the line indicated by "c1" represents the leading edge position of an image to be formed on the sheet of the first page (page 1). The line indicated by "c2" represents the leading edge position of an image to be formed on the sheet of the second page (page 2). The image formed on the photosensitive drum 22 is carried to the secondary transfer portion 21 at a constant speed via the intermediate transfer member 26. A time period required for carrying the image formed on the photosensitive drum 22 to the secondary transfer portion 21 is "ct1". The image forming processing is performed at a given time interval.

The line indicated by "c3" represents the leading edge position of the sheet of the first page in the conveyance direction. The line indicated by "c4" represents the trailing edge position of the sheet of the first page in the conveyance direction. The second sheet feeding apparatus 301 receives the feed request from the image forming apparatus 101, and starts to feed the sheet of the first page. A time period required for the leading edge of the sheet of the first page fed from the sheet feeding unit 40 of the second sheet feeding apparatus 301 to reach the taking-in portion 54 of the sheet conveying apparatus 401 is "ct2". The sheet conveying apparatus 401 conveys the taken-in sheet to the position immediately before the position at which the leading edge reaches the taking-in portion 17 of the image forming apparatus 101 based on a detection result obtained by the horizontal path conveyance sensor 53, and stops the conveyance of the sheet at the same position. A time period required for the leading edge of the sheet of the first page being conveyed from the taking-in portion 54 of the sheet conveying apparatus 401 to reach the position immediately before the position at which the sheet reaches the taking-in portion 17 is "ct3". A time period for which the conveyance of the sheet is being stopped at the position immediately before the position at which the sheet reaches the taking-in portion 17 is "ct4".

When receiving the delivery request from the image forming apparatus 101, the sheet conveying apparatus 401 restarts the conveyance of the sheet of the first page to deliver the sheet of the first page to the image forming apparatus 101. Immediately after the conveyance of the sheet of the first page taken into the image forming apparatus 101 is stopped with the leading edge being brought into abutment with the registration rollers 12, the conveyance is restarted to convey the sheet to the secondary transfer portion 21. A time period required after the sheet of the first page is delivered until the leading edge of the sheet has been conveyed to the secondary transfer portion 21 is "ct5".

The line indicated by "c5" represents the leading edge position of the sheet of the second page in the conveyance direction. The line indicated by "c6" represents the trailing edge position of the sheet of the second page in the conveyance direction. The image forming apparatus 101 sends the feed request for the sheet of the second page to the second sheet feeding apparatus 301 at such a timing as to cause the sheet of the second page to reach the taking-in portion 54 of the sheet conveying apparatus 401 at the timing to send the delivery request for the sheet of the first page to the sheet conveying apparatus 401. Timings after the feeding of the sheet of the second page are substantially the same as those for the sheet of the first page except for a time period for which the conveyance of the sheet is being stopped at the position immediately before the position at which the sheet reaches the taking-in portion 17. The time period for which the conveyance of the sheet of the second page is being stopped at the position immediately before the position at which the sheet reaches the taking-in portion 17 is a difference between the time "ct5" and the time "ct3".

The feed start timing of the sheet of the first page is earlier than the image formation start timing of the image to be formed on the sheet of the first page by a time "ctp1". The time "ctp1" is expressed by "ct1−(ct5+ct2+ct3+ct4)". In this case, a time period ct4 for which the sheet is kept standing by at the position immediately before the taking-in portion 17 has a value equal to or larger than zero. That is, the image forming apparatus 101 sends the feed request to the second sheet feeding apparatus 301 at a timing calculated back from the timing at which the images are carried to the secondary transfer portion 21. The feed start timing of the sheet of the second page is a timing to cause the sheet to reach the taking-in portion 54 of the sheet conveying apparatus 401 at the timing at which the sheet that has temporarily stopped being conveyed on the conveyance path 55 in the sheet conveying apparatus 401 is delivered to the image forming apparatus 101. In the example of FIG. 6B, the feed start timing of the sheet of the second page is later than the image formation start timing of the image to be formed on the sheet of the first page by a time "ctp2". The time "ctp2" is expressed by "ct1−(ct5+ct2+ct3)". The image forming apparatus 101 also sends the feed request for the sheet of each of the third page and the subsequent pages to the second sheet feeding apparatus 301 at a timing later than the image formation start timing of the image to be formed on the sheet of the previous page by the time "ctp2". The image forming apparatus 101 sends the feed request to the second sheet feeding apparatus 301 at each of the feed start timings. The feed request is sent in the above-mentioned manner, to thereby prevent two or more sheets from being conveyed on the conveyance path at the same timing. The delivery request is sent to the sheet conveying apparatus 401 at a timing earlier than the timing at which the images are carried to the secondary transfer portion 21 by a time period required for the supplied sheet to be conveyed to the secondary transfer portion 21 in the image forming apparatus 101.

In the respective timing charts of FIG. 6A and FIG. 6B, the conveyance speeds of the sheet are the same in each of the image forming apparatus 101, the second sheet feeding apparatus 301, and the sheet conveying apparatus 401. In addition, the distance of the conveyance path from the sheet feeding unit 40 to the taking-in portion 17 (FIG. 6A) is the same as the distance of the conveyance path from the sheet feeding unit 40 to the taking-in portion 17 via the taking-in portion 54 (FIG. 6B). In this case, the sheet conveyance time is "b2t2+b2t3" in FIG. 6A and "ct2+ct3+ct5" in FIG. 6B, which are the same value. Therefore, the sheet is conveyed in a shorter period in the timing chart of FIG. 6A by the time period (ct4) for which the conveyance of the sheet is being stopped.

Even when the conveyance speed of the sheet or the conveyance distance of the sheet is different for each apparatus constructing the sheet supplying mechanism 102, the image forming apparatus 101 can calculate, for each apparatus, the time period required until the sheet is discharged to the outside of the corresponding apparatus based on the information for calculating the sheet conveyance time required in each apparatus. This enables the image forming apparatus 101 to appropriately determine the timings to send the feed request and the delivery request.

As described above, the image forming apparatus 101 according to this embodiment sends the feed request and the delivery request at the timing suitable for the configuration of the sheet supplying mechanism 102 connected on the upstream side. This can prevent a plurality of sheets from being conveyed at the same timing on the conveyance path in the sheet supplying mechanism 102. Further, the image forming apparatus 101 can receive a sheet with a minimum sheet-to-sheet interval based on the configuration of the sheet supplying mechanism 102. This allows the productivity of the image forming apparatus 101 to be ensured even when there is a difference in configuration of the sheet supplying mechanism 102.

According to this embodiment, there is provided an image forming apparatus configured to determine the timings to send the feed request and the delivery request based on the apparatus information on the apparatus constructing the sheet supplying mechanism 102, to thereby supply the sheet while ensuring the productivity.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-105271, filed May 29, 2017, which is hereby incorporated by reference herein in its entirety.

What is claimed is:

1. An image forming apparatus, which has a receiving portion configured to receive sheets from outside, the image forming apparatus being operable in a first configuration in which a conveying path of a first sheet feeding apparatus is connected to the receiving portion of the image forming apparatus and a second configuration in which a conveying path of a sheet conveying apparatus is connected to the receiving portion of the image forming apparatus and a second sheet feeding apparatus is connected to the sheet conveying apparatus on an upstream side with respect to a sheet conveying direction, the first sheet feeding apparatus comprising a first control unit configured to control conveyance of a sheet and being configured to temporarily stop the conveyance of the sheet within the conveyance path thereof, the second sheet feeding apparatus comprising a second control unit configured to control conveyance of a sheet and being configured not to temporarily stop the conveyance of a sheet within a conveyance path thereof, the sheet conveying apparatus comprising a third control unit configured to control conveyance of a sheet, being configured to receive the sheet from the second sheet feeding apparatus, and being configured to temporarily stop the conveyance of the sheet in the conveyance path within the sheet conveying apparatus, and the image forming apparatus being configured to form an image on the sheet fed from the first sheet feeding apparatus in the first configuration and the image forming apparatus being configured to form an image on the sheet fed from the second sheet feeding apparatus through the sheet conveying apparatus in the second configuration, the image forming apparatus comprising:

an image former configured to form an image on the sheet based on a print job;

an obtaining device configured to obtain apparatus information corresponding to whether the image forming apparatus is operated in the first configuration or the second configuration; and a controller configured to determine, based on the apparatus information obtained by the obtaining device, timings to send a feed request for starting to feed the sheet and a delivery request for instructing to deliver the sheet, wherein the receiving portion to which the sheet conveying apparatus is connected is common to the receiving portion to which the first sheet feeding apparatus is connected, wherein in a case in which the image forming apparatus is operated in the first configuration and forms the image on the sheet fed from the first sheet feeding apparatus, the controller sends the feed request to the first sheet feeding apparatus, sends to the first control unit the delivery request for a first sheet fed according to the feed request and temporarily stopped at a first predetermined position in the first sheet feeding apparatus, and sends to the first control unit the feed request for a second sheet subsequent to the first sheet at a timing coincident with a sending timing of the delivery request or at a timing before the sending timing of the delivery request, and wherein in a case in which the image forming apparatus is operated in the second configuration and forms the image on the sheet fed from the second sheet feeding apparatus, the controller sends the feed request to the second sheet feeding apparatus, sends to the third control unit the delivery request for a third sheet fed according to the feed request and temporarily stopped at a second predetermined position in the sheet conveying apparatus, and sends the feed request for a fourth sheet to the second sheet feeding apparatus at such a timing as to cause the fourth sheet to be conveyed to the sheet conveying apparatus at a timing at which the third sheet is conveyed from the sheet conveying apparatus to the image forming apparatus.

2. An image forming apparatus according to claim 1, further comprising a storage configured to store, for each of the first configuration and the second configuration, information for calculating a sheet conveyance time, wherein the controller reads the information for calculating the sheet conveyance time from the storage based on the apparatus information to determine the timing to send the feed request based on the information read from the storage.

3. An image forming apparatus according to claim 2, wherein the image former includes:

a photosensitive member on which an image is to be formed; and a transferer configured to transfer the image formed on the photosensitive member onto the sheet, wherein the storage stores a conveyance distance and a conveyance speed of the sheet in each of the first sheet feeding apparatus and the second sheet feeding apparatus, and wherein the controller determines the timing to send the feed request based on a time period required for the image to be formed on the photosensitive member to reach a transfer position at which the image is to be transferred by the transferer, the conveyance speed, and the conveyance distance.

4. An image forming apparatus according to claim 3, wherein the controller determines, in the case in which the image forming apparatus is operated in the first configuration, the timing to send the feed request for the first sheet to the first sheet feeding apparatus based on a time period required for the image to reach the transfer position from the photosensitive member, a time period required for the sheet to be conveyed in the first sheet feeding apparatus, a time period for temporarily stopping the conveyance of the first sheet in the first sheet feeding apparatus, and a time period required for conveying the first sheet, which has been fed from the first sheet feeding apparatus to the image forming apparatus, to the transfer position.

5. An image forming apparatus according to claim 4, wherein the controller determines the timing to send the delivery request for the first sheet to the first sheet feeding apparatus based on a timing at which the image reaches the transfer position from the photosensitive member and the time period required for conveying the first sheet, which has been fed from the first sheet feeding apparatus to the image forming apparatus, to the transfer position.

6. An image forming apparatus according to claim 5, wherein the controller sends the feed request for the second sheet to the first sheet feeding apparatus simultaneously with the delivery request for the first sheet.

7. An image forming apparatus according to claim 3, wherein the controller determines, in the case in which the image forming apparatus is operated in the second configuration, the timing to send the feed request for the third sheet to the second sheet feeding apparatus based on a time period required for the image to reach the transfer position from the photosensitive member, a time period required for the third sheet to be conveyed in the second sheet feeding apparatus, a time period required for the third sheet to be conveyed in the sheet conveying apparatus, a time period for temporarily stopping the conveyance of the third sheet in the sheet conveying apparatus, and a time period required for conveying the third sheet, which has been conveyed from the sheet conveying apparatus to the image forming apparatus, to the transfer position.

8. An image forming apparatus according to claim 7, wherein the controller determines the timing to send the delivery request for the third sheet to the sheet conveying apparatus based on a timing at which the image reaches the transfer position from the photosensitive member and the time period required for conveying the third sheet, which has been conveyed from the sheet conveying apparatus to the image forming apparatus, to the transfer position.

* * * * *